US007453211B2

(12) United States Patent
Yoo

(10) Patent No.: US 7,453,211 B2
(45) Date of Patent: Nov. 18, 2008

(54) PLASMA DISPLAY PANEL HAVING DIELECTRIC LAYERS AND IGNITING ELECTRODES

(75) Inventor: Hun-Suk Yoo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 290 days.

(21) Appl. No.: 11/363,154

(22) Filed: Feb. 28, 2006

(65) Prior Publication Data

US 2006/0208638 A1 Sep. 21, 2006

(30) Foreign Application Priority Data

Mar. 16, 2005 (KR) ..... 10-2005-0021974

(51) Int. Cl.
*H01J 17/49* (2006.01)

(52) U.S. Cl. ..... 313/587; 313/584; 313/585; 313/586

(58) Field of Classification Search ..... 313/582–587
See application file for complete search history.

(56) References Cited

U.S. PATENT DOCUMENTS 5,541,618 A 7/1996 Shinoda (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Toan Ton
*Assistant Examiner*—Bumsuk Won
(74) *Attorney, Agent, or Firm*—Robert E. Bushnell, Esq.

(57) ABSTRACT

A plasma display panel includes a first substrate and a second substrate facing each other; barrier ribs forming discharge cells between the first substrate and the second substrate; a phosphor layer formed on the inside of the discharge cell; address electrodes formed on the first substrate in a first direction; a first display electrode and a second display electrode, both formed on the second substrate in a second direction crossing the first direction, the display electrodes having at least a pair of enlarged electrodes corresponding to each discharge cell; a first igniting electrode and a second igniting electrode, each formed protruding toward the center of the discharge cell at one end of the extended electrode, over the barrier ribs and along the barrier ribs, respectively from the first display electrode and the second display electrode; a first dielectric layer, formed on the second substrate covering the first display electrode and the second display electrode, having a first opening formed between the first display electrode and the second display electrode; and a second dielectric layer formed independently covering the first and the second igniting electrodes exposed to the first opening of the first dielectric layer.

20 Claims, 5 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto et al. | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0084752 | A1* | 7/2002 | Yoshioka et al. | 313/584 |
| 2004/0150340 | A1 | 8/2004 | Son et al. | |
| 2005/0029946 | A1* | 2/2005 | Kwon et al. | 313/584 |
| 2006/0043891 | A1* | 3/2006 | Tessier et al. | 313/581 |

FOREIGN PATENT DOCUMENTS

| | | |
|---|---|---|
| JP | 2845183 | 10/1998 |
| JP | 2917279 | 4/1999 |
| JP | 01-043804 | 2/2001 |
| JP | 2001-043804 | 2/2001 |
| JP | 01-325888 | 11/2001 |
| JP | 2001-325888 | 11/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

PLASMA DISPLAY PANEL HAVING DIELECTRIC LAYERS AND IGNITING ELECTRODES

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 16 Mar. 2005 and there duly assigned Ser. No. 10-2005-0021974.

BACKGROUND OF THE INVENTION

1. Field of the Invention

The present invention relates to a plasma display panel and, in particular, to a plasma display panel in which a driving voltage is lowered, and luminous efficiency is improved.

2. Description of the Related Art

A plasma display panel (PDP) is generally a display device in which vacuum ultraviolet (VUV) rays from plasma generated by gas discharge excite phosphors to emit red (R), green (G), blue (B) visible lights for producing an image.

In a typical alternating current PDP, address electrodes are formed on a rear substrate and extends in one direction. A dielectric layer is formed on the rear substrate to cover the address electrodes. On top of the dielectric layer, barrier ribs positioned between the address electrodes are formed in a stripe pattern, and red(R), green (G) and blue (B) phosphor layers are formed between the barrier ribs On a first surface of a front substrate facing the rear substrate, formed along one direction crossing the address electrode are display electrodes, each including a pair of a transparent electrode and a bus electrode. A dielectric layer and a MgO protective layer in turn are formed on the entire front substrate covering the display electrodes.

Discharge cells are formed at locations where the address electrodes of the rear substrate cross the display electrodes of the front substrate. The PDP has millions of discharge cells arranged in a matrix pattern.

Such an AC PDP adopts a driving method using memory characteristics to drive such a large number of discharge cells simultaneously. To be specific, a voltage difference over a certain value is necessary to start a discharge between a sustain electrode and a scan electrode, both composing a pair of the display electrodes. A threshold voltage having the certain value is called a firing voltage (Vf).

When an address voltage (Va) is applied between the scan electrode and the address electrode, the discharge starts. The plasma is generated by the discharge in the discharge cell, and the electrons and ions in the plasma move toward the electrodes having the opposite polarity. As a result, the electrical current flows.

Since the dielectric layer is coated on each electrode of the AC PDP, most of the moving space charge is deposited on the dielectric layer with the opposite polarity. Therefore, the net voltage difference across the gap between the scan electrode and the address electrode becomes smaller than the initial address voltage (Va), and that causes the discharge to be weak and disappear eventually.

At this time, the dielectric layer on the scan electrode collects a relatively large amount of the ions, compared to the dielectric layer on the sustain electrode. The accumulated charges on the dielectric layer over the sustain and scan electrodes are called the wall charge (Qw). Also, the voltage across the space between the sustain and scan electrodes is called the wall voltage (Vw).

For the case where a certain voltage (Vs; discharge sustain voltage) is applied between the sustain electrode and the scan electrode successively, the discharge starts in the discharge cell when the sum (Vs+Vw) of the discharge sustain voltage (Vs) and the wall voltage (Vw) exceeds the firing voltage (Vf). The vacuum ultraviolet ray generated at this moment excites the corresponding phosphor layer so that visible lights are emitted, and the transparent front substrate transmits the visible light to show an image.

In the manufacturing process of a PDP, however, a dielectric layer is formed uniform in thickness over the scan and sustain electrodes on the front substrate. While the dielectric layer with a uniform thickness facilitates the manufacturing process, it lowers a discharge efficiency due to a long path in the electric field where the surface discharge occurs between the sustain electrode and the scan electrode.

Therefore, a higher discharge sustain voltage (Vs) is required between the sustain electrode and the scan electrode and leads to a higher discharge voltage for driving the PDP. As a result, the PDP need a large electric power consumption and emits electromagnetic interference resulted from the high voltage driving.

Also, the uniform thickness of the dielectric layer formed between the sustain electrode and the scan electrode reduces the transmittance of the generated visible light through the front substrate and results in a PDP with low luminance and low luminous efficiency.

SUMMARY OF THE INVENTION

The present invention provides a plasma display panel in which low electric power consumption and low generation of electromagnetic interference due to a low voltage driving is achieved by improving the efficiency of the sustain discharge between the display electrodes and moreover, the luminous efficiency of the panel is enhanced by a higher visible light transmittance.

A plasma display panel of the present invention includes a first substrate and a second substrate facing each other; barrier ribs forming discharge cells between the first substrate and the second substrate; a phosphor layer formed on the inside of the discharge cell; and address electrodes formed on the first substrate in a first direction. The plasma display panel also includes a first display electrode and a second display electrode, both formed on the second substrate in a second direction crossing the first direction, the display electrodes having at least a pair of enlarged electrodes corresponding to each discharge cell; a first igniting electrode and a second igniting electrode, each formed protruding toward the center of the discharge cell at one end of the extended electrode, over the barrier ribs and along the barrier ribs, respectively from the first display electrode and the second display electrode; a first dielectric layer, formed on the second substrate covering the first display electrode and the second display electrode, having a first opening formed between the first display electrode and the second display electrode; and a second dielectric layer formed independently covering the first and the second igniting electrodes exposed to the first opening of the first dielectric layer.

In an exemplary embodiment of the present invention, a second opening may be formed between the first dielectric layer and the second dielectric layer covering the first and the second igniting electrodes.

In another exemplary embodiment of the present invention, the second dielectric layer is formed covering independently the first and the second igniting electrodes exposed to the first opening of the first dielectric layer and may have a second opening between the first and the second igniting electrodes. Also, a third opening may be formed between the first dielectric layer and the second dielectric layer.

Each of the first and the second igniting electrodes extends respectively from the first and the second display electrodes and branches off toward the centers of two neighboring discharge II cell in the second direction.

As described above, the plasma display panel of the present invention includes the first and the second igniting electrodes formed between the first and the second display electrodes and separated dielectric layers independently so as to have each opening formed respectively between the first and the second display electrodes. This arrangement shortens the path of the electric field between the electrodes and achieves low electric power consumption and low generation of electromagnetic interference by improving the discharge efficiency.

Also, the luminous efficiency of the plasma display panel may be improved by the openings that increase the visible light transmittance to the front substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
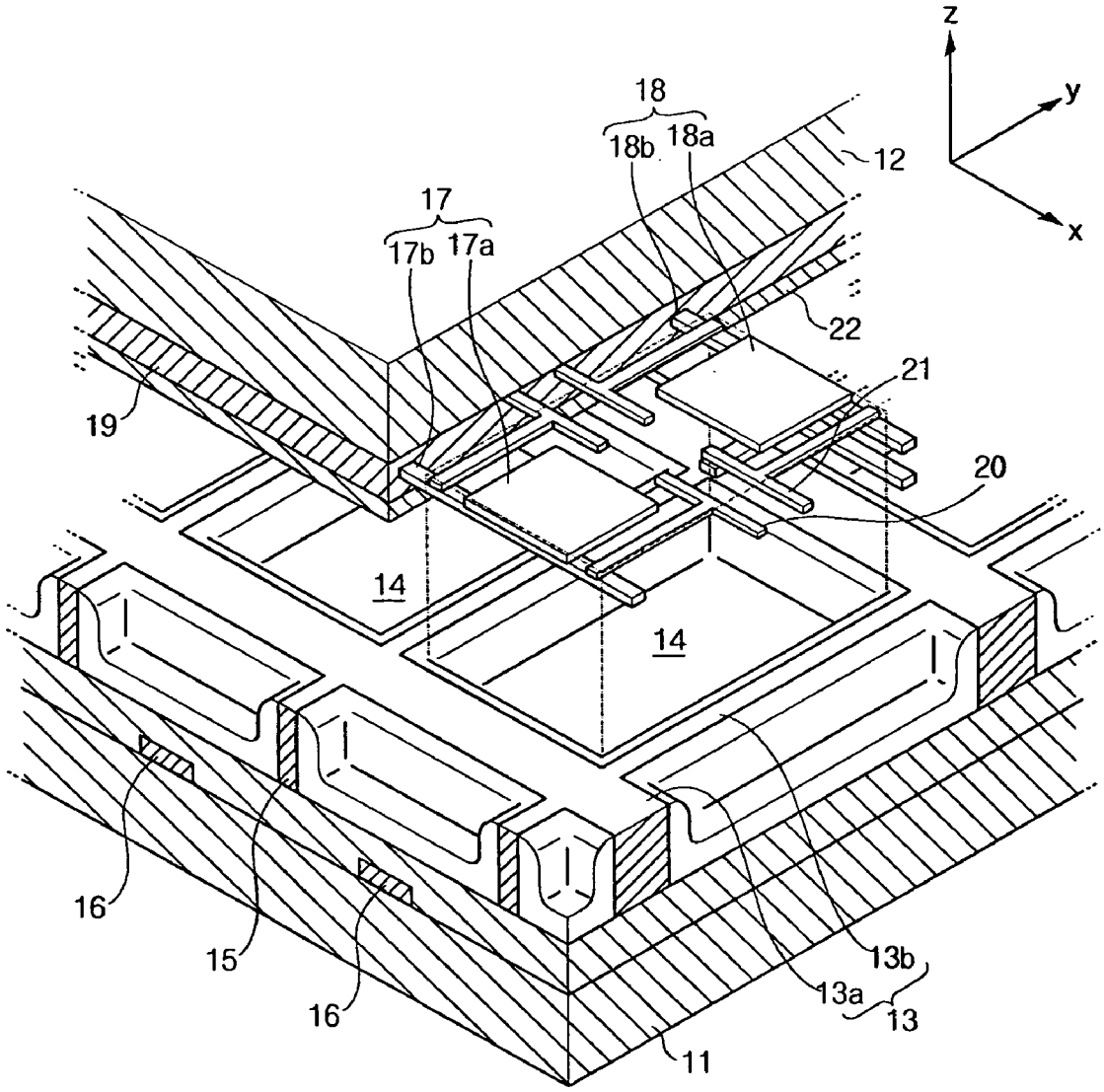
FIG. 1 is a partial perspective view of a disassembled plasma display panel according to a first exemplary embodiment of the present invention.

As shown in FIG. 1, a plasma display panel (PDP) includes a first substrate 11 (a rear substrate); and a second substrate 12 (a front substrate) facing the first substrate 11. A plurality of discharge cells 14 for plasma discharge are formed by a plurality of barrier ribs 13 positioned between the rear substrate 11 and the front substrate 12. A phosphor layer 15 with one of Red (R), green (G) and blue (G) phosphors is formed on the inside of each discharge cell 14.

On a surface of the rear substrate 11 facing the front substrate 12, formed along a first direction (y-direction) are address electrodes 16 that are positioned in parallel to neighboring address electrodes 16 with a predetermined gap.

Corresponding to the discharge cells 14, display electrodes, i.e. a first and a second display electrodes 17, 18 are formed on the front substrate 12, extending in a second direction (x-direction) and placed parallel to each other with a pitch of the discharge cells 14 in the first direction.

The barrier ribs 13 placed between the rear substrate 11 and the front substrate 12 include a first barrier rib member 13*a* and a second barrier rib member 13*b* , both forming the discharge cells in a matrix pattern.

The first barrier rib member 13*a* is placed parallel to the neighboring other first barrier rib members 13*a*. The second barrier rib members 13*b* are placed perpendicular to the first barrier rib members 13*a* while keeping parallel to other second barrier rib members 13*b*. Thus, the first and second barrier rib members 13*a*, 13*b* define the discharge cells for plasma discharge.

Figure 2:
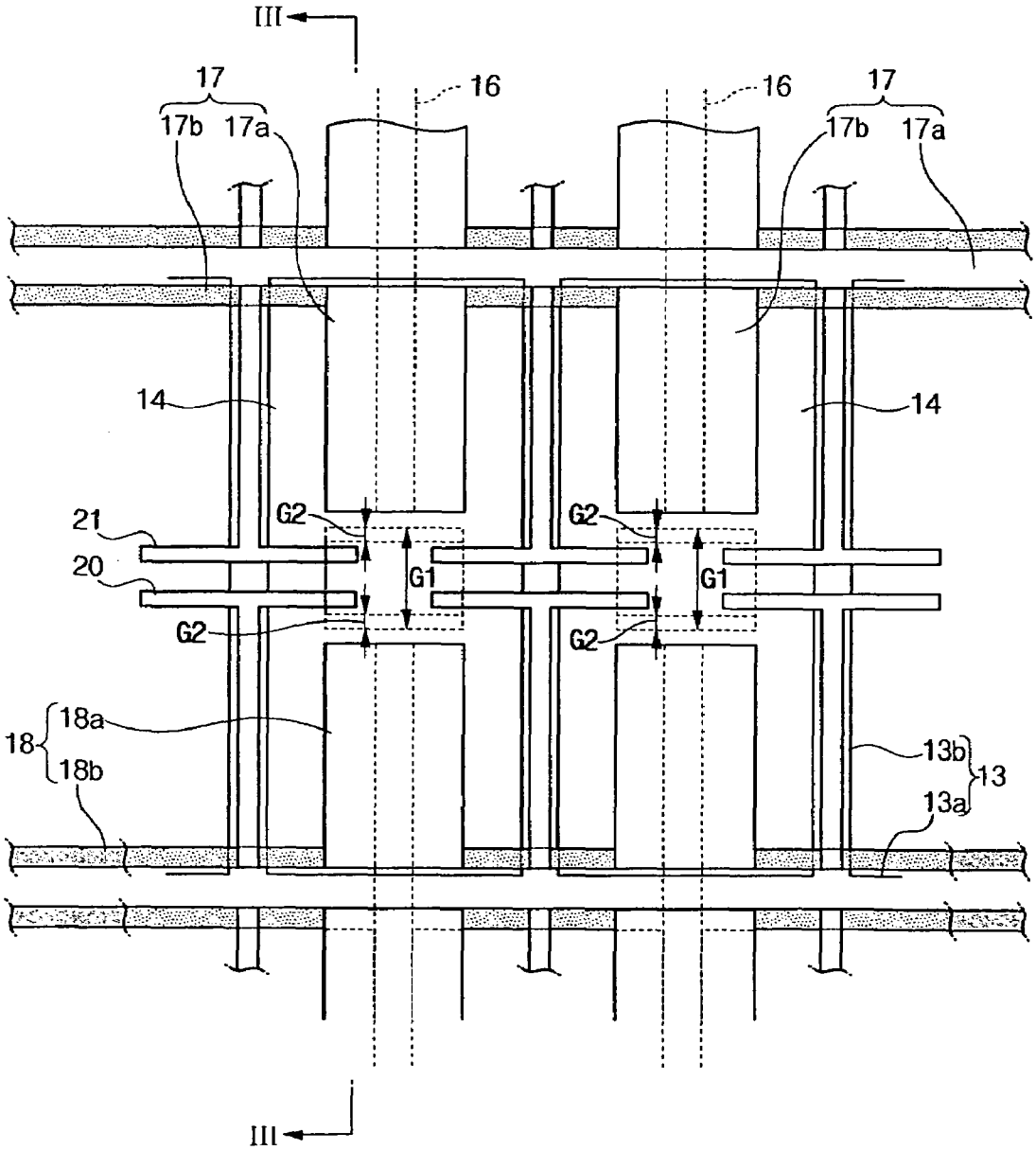
FIG. 2 is a partial plan view showing the arrangement of electrodes and the opening patterns of a dielectric layer in the plasma display panel according to the first exemplary embodiment of the present invention.
Figure 3:
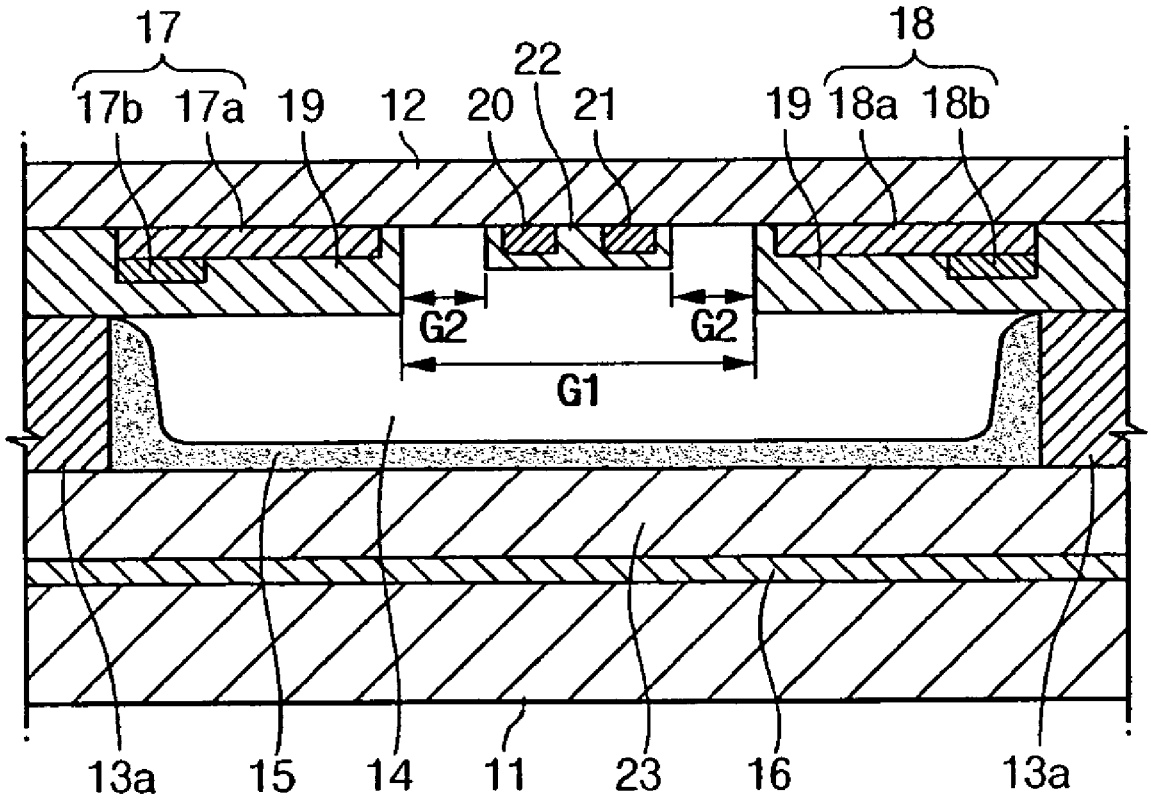
FIG. 3 is a cross-sectional view taken along the section line III-III of FIG. 2.

As shown in FIGS. 2 and 3, each of the first display electrode 17 and the second display electrode 18 includes a bus electrode 17*b*, 18*b* extending in the second direction (x-direction) and an enlarged electrode 17*a*, 18*a* protruding from the bus electrode 17*b*, 18*b* toward the center of each discharge cell 14. Both bus electrodes 17*b*, 18*b* may be formed respectively near both sides of the discharge cell 14, and a pair of the enlarged electrodes 17*a*, 18*a* is formed facing each other in the discharge cell 14.

The enlarged electrodes 17*a*, 18*a* serve to cause plasma discharge inside each discharge cell 14 and may be made of transparent indium-tin oxide (ITO) to obtain a high opening ratio. The bus electrodes 17*b*, 18*b* may be made of a metallic material to obtain high conductance for compensating high resistance of the enlarged electrodes 17*a*, 18*a*.

In order to cover and protect the display electrodes 17, 18, a first dielectric layer 19 is formed on the front substrate 12. The first dielectric layer 19 has a first opening G1 formed in the space between the paired enlarged electrodes 17*a*, 18*a*.

In the first opening G1 of the first dielectric layer 19, a face discharge between the first display electrode 17 and the second display electrode 18 is induced to start the discharge. A surface discharge is induced and propagat es on the surface of the first dielectric layer 19 ranging from the perimeter of the first opening G1 to the outer edge of the discharge cell 14.

Therefore, a face discharge occurs substantially between the first display electrode 17 and the second display electrode 18 and lowers the firing voltage (Vf). As a result, the discharge efficiency may be improved due to both a short discharge path near the first opening G1 of the first dielectric layer 19 and a strong electric field formed thereby.

In addition, a first igniting electrode 20 and a second igniting electrode 21 are formed respectively at each end of the extended electrodes along the second barrier rib members 13*b* from the first display electrode 17 and the second display electrode 18. Each of the first igniting electrode 20 and the second igniting electrode 21 protrudes toward the first opening G1 between the enlarged electrodes 17*a*, 18*a* of the first and the second display electrodes 17, 18, respectively.

The first and the second igniting electrodes 20, 21 serve to cause an initial sustain discharge before the full sustain discharge occurs between the first and the second display electrodes 17, 18 after the address discharge between the address electrode 16 and the second display electrode 18. Therefore, such a low voltage driving results in both the low electric power. consumption and the low electromagnetic interference.

Since the end portions of the first and the second igniting electrodes 20, 21 are protruded into the first opening G1 of the first dielectric layer 19, a second dielectric layer 22 is formed independently to cover the exposed portions of the first and the second igniting electrodes 20, 21 to the first opening G1.

The second dielectric layer 22 is formed on the front substrate in a manner that a second opening G2 is placed between the second dielectric layer 22 and the first dielectric layer 19.

The second opening G2 formed between the second dielectric layer 22 and the first dielectric layer 19 improves a luminance by serving as a light passage that transmits visible light generated inside the discharge cell to the front substrate 12. Therefore, the second opening G2 may improve the luminous efficiency of the PDP.

Figure 4:
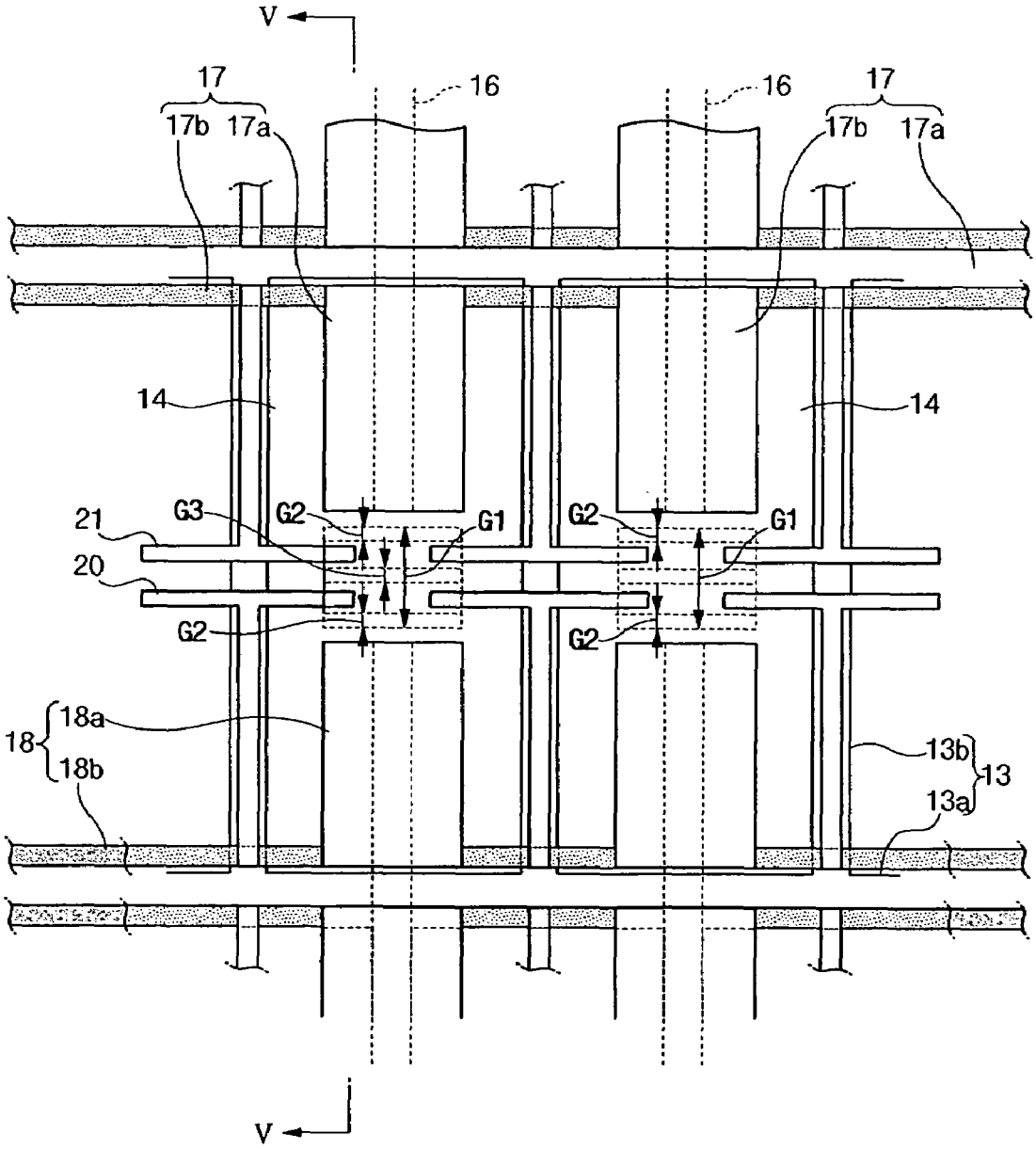
FIG. 4 is a partial plan view showing the arrangement of electrodes and the opening patterns of a dielectric layer in the plasma display panel according to a second exemplary embodiment of the present invention.
Figure 5:
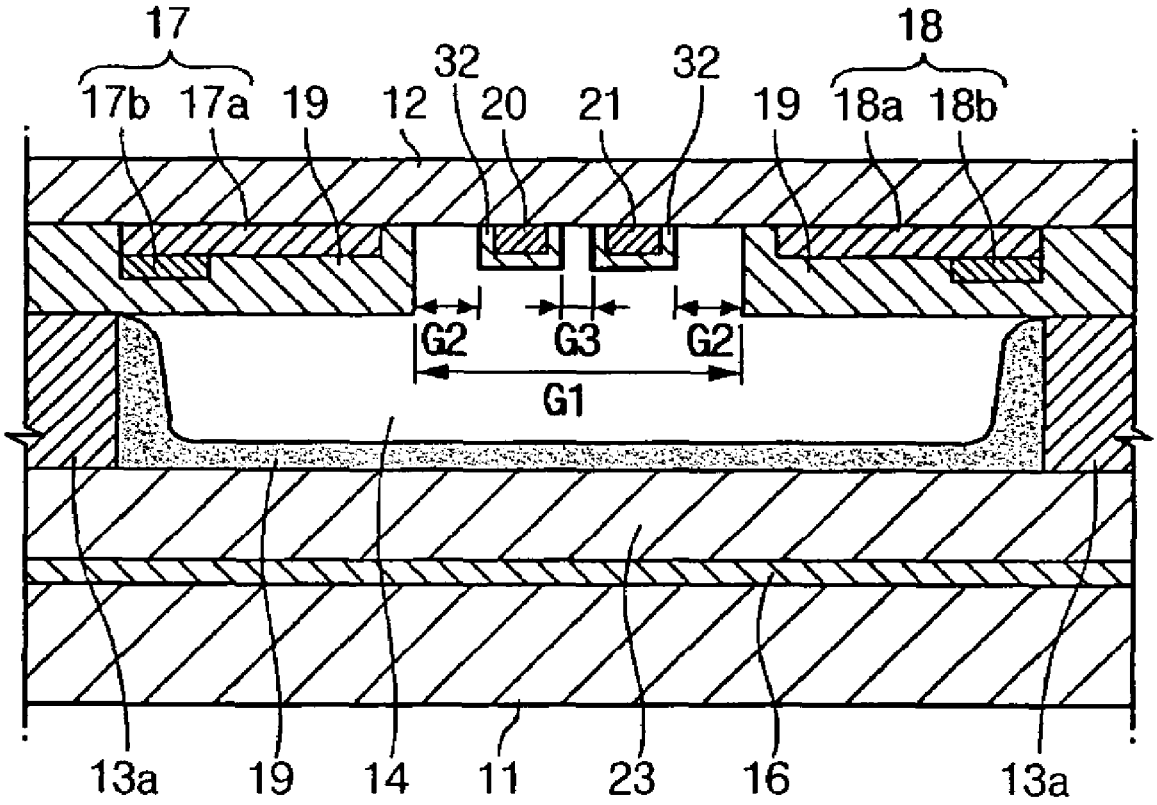
FIG. 5 is a cross-sectional view taken along the section line V-V of FIG. 4.

As shown in FIGS. 4 and 5, the second dielectric layer 32 has a third opening G3 formed between the first and the second igniting electrodes 20, 21 while covering the first and the second igniting electrodes 20, 21 for protection and having the second opening G2 formed between the second dielectric layer 32 and the first dielectric layer 19.

The second dielectric layer 32 may be formed by coating with the insulating material, the first and the second igniting electrodes 20, 21 made of a conducting material.

The initial sustain discharge between the first and the second igniting electrodes 20, 21 may occur at a lower voltage by generating a face discharge in the third opening G3 formed between the first and the second igniting electrodes 20, 21.

Therefore, such a low voltage driving results in the low electric power consumption and prevents electromagnetic interference that is emitted by a high voltage driving.

Also, the third opening G3 formed between the first and the second igniting electrodes 20, 21 transmits more visible light to the front substrate 12 and may improve both the luminance and the luminous efficiency of the PDP.

Although exemplary embodiments of the present invention have been described in detail hereinabove, it should be understood that many variations and/or modifications of the basic inventive concept taught therein will still fall within the spirit and scope of the present invention, as defined in the appended claims.

What is claimed is:

1. A plasma display panel comprising:

a first substrate and a second substrate facing each other;

barrier ribs forming discharge cells between said first substrate and said second substrate;

a phosphor layer formed on the inside of the discharge cell;

address electrodes formed on said first substrate in a first direction;

a first display electrode and a second display electrode, both formed on said second substrate in a second direction crossing the first direction, said display electrodes comprising at least a pair of enlarged electrodes corresponding to each discharge cell;

a first igniting electrode and a second igniting electrode, each formed protruding toward the center of the discharge cell at one end of the extended electrode, over the barrier ribs and along said barrier ribs, respectively from said first display electrode and the second display electrode;

a first dielectric layer, formed on said second substrate covering said first display electrode and said second display electrode, comprising a first opening formed between said first display electrode and said second display electrode; and a second dielectric layer formed covering said first and said second igniting electrodes exposed to the first opening of said first dielectric layer.

2. The plasma display panel of claim 1, wherein a second opening is formed between said first dielectric layer and said second dielectric layer covering said first and said second igniting electrodes.

3. The plasma display panel of claim 1, wherein said second dielectric layer is formed covering independently said first and the second igniting electrodes exposed to the first opening of said first dielectric layer.

4. The plasma display panel of claim 3, wherein said second dielectric layer comprises a second opening formed between said first and said second igniting electrodes.

5. The plasma display panel of claim 4, wherein a third opening is formed between said first dielectric layer and said second dielectric layer.

6. The plasma display panel of claim 1, wherein each one of said first and said second igniting electrodes extends respectively from said first and said second display electrodes and branches off toward the centers of two neighboring discharge cell in the second direction.

7. A display panel, comprising:

a first substrate and a second substrate facing each other;

barrier ribs forming discharge cells between said first substrate and said second substrate;

address electrodes formed on said first substrate in a first direction;

a first display electrode and a second display electrode, both formed on said second substrate in a second direction crossing the first direction, said display electrodes comprising a pair of enlarged electrodes corresponding to each discharge cell;

a first igniting electrode and a second igniting electrode, each formed protruding toward the discharge cell at one end of the extended electrode, over said barrier ribs and along said barrier ribs, respectively from said first display electrode and the second display electrode; and a first dielectric layer, formed on said second substrate covering said first display electrode and said second display electrode, comprising a first opening formed between said first display electrode and said second display electrode, wherein a part of said first igniting electrode and a part of said second igniting electrode are both exposed by said first opening.

8. The display panel of claim 7, further comprising a second dielectric layer formed covering said first and said second igniting electrodes exposed to the first opening of said first dielectric layer.

9. The display panel of claim 8, wherein a second opening is formed between said first dielectric layer and said second dielectric layer covering said first and said second igniting electrodes.

10. The display panel of claim 8, wherein said second dielectric layer is formed covering separately said first and the second igniting electrodes exposed to the first opening of said first dielectric layer.

11. The display panel of claim 8, wherein said second dielectric layer comprises a second opening formed between said first and said second igniting electrodes.

12. The display panel of claim 8, wherein a third opening is formed between said first dielectric layer and said second dielectric layer.

13. The display panel of claim 7, wherein each one of said first and said second igniting electrodes extends respectively from said first and said second display electrodes and branches off toward the centers of two neighboring discharge cell in the second direction.

14. The display panel of claim 7, wherein the first and second directions are substantially perpendicular to each other.

15. A plasma display panel, comprising:

a first substrate and a second substrate spaced apart from each other;

barrier ribs forming discharge cells between said first substrate and said second substrate;

address electrodes formed on said first substrate in a first direction;

a first display electrode and a second display electrode, both formed on said second substrate in a second direction not parallel to the first direction, each one of said first and second display electrodes comprising of bus electrodes and enlarged electrodes extending from said bus electrodes corresponding to each discharge cell, said enlarged electrodes extending toward a center of the discharge cells;

a first dielectric layer, formed on said second substrate covering said first display electrode and said second display electrode, comprising a first opening formed between a space between paired said first display electrode and said second display electrode; and a second dielectric layer formed inside said first opening, wherein a second opening is placed between said second dielectric layer and said first dielectric layer.

16. The plasma display panel of claim 15, further comprising:

a first igniting electrode being formed at the end of said first display electrode and a second igniting electrode formed at the end of said second display electrode, each one of said first and second igniting electrodes formed protruding toward the center of the discharge cell along one of the members of said barrier ribs, wherein the second dielectric layer is formed covering said first and said second igniting electrodes exposed to the first opening of said first dielectric layer.

17. The plasma display panel of claim 16, wherein a resistance of said enlarged electrodes is greater than said bus electrodes.

18. The plasma display panel of claim 17, wherein said second dielectric layer is formed covering independently said first and the second igniting electrodes exposed to the first opening of said first dielectric layer

19. The plasma display panel of claim 18, wherein said second dielectric layer comprises the second opening formed between said first and said second igniting electrodes.

20. The plasma display panel of claim 19, wherein a third opening is formed between said first dielectric layer and said second dielectric layer and each one of said first and said second igniting electrodes extends respectively from said first and said second display electrodes and branches off toward the centers of two neighboring discharge cell in the second direction.

* * * * *